US007188472B2

(12) United States Patent
Nordborg et al.

(10) Patent No.: US 7,188,472 B2
(45) Date of Patent: Mar. 13, 2007

(54) METHOD AND HYDROMACHINE FOR CONTROLLING A DISPLACEMENT

(75) Inventors: Martin Nordborg, Soenderborg (DK); Kim René Hansen, Soenderborg (DK); Heinrich Arnaud, Thann (FR)

(73) Assignee: Sauer-Danfoss Aps, Nordborg (DK)

( * ) Notice: Subject to any disclaimer, the term of this patent is extended or adjusted under 35 U.S.C. 154(b) by 34 days.

(21) Appl. No.: 11/107,196

(22) Filed: Apr. 15, 2005

(65) Prior Publication Data

US 2005/0238521 A1 Oct. 27, 2005

(30) Foreign Application Priority Data

Apr. 26, 2004 (DE) ..... 10 2004 020 357

(51) Int. Cl.
*F03C 2/08* (2006.01)
*F04C 14/02* (2006.01)

(52) U.S. Cl. ..... 60/487; 418/60

(58) Field of Classification Search ..... 60/465, 60/487; 417/212, 216; 418/9, 60, 61.3, 418/69, 108, 109
See application file for complete search history.

(56) References Cited

U.S. PATENT DOCUMENTS 3,687,578 A 8/1972 White, Jr. et al. ..... 418/21
4,493,622 A 1/1985 Miller ..... 418/57
4,875,841 A * 10/1989 White, Jr. ..... 418/61.3
5,290,153 A * 3/1994 Schmidt ..... 417/223
6,544,018 B2 * 4/2003 Heckel et al. ..... 418/61.3
6,568,930 B2 * 5/2003 Schmidl et al. ..... 418/109

FOREIGN PATENT DOCUMENTS

| | | |
|---|---|---|
| DE | 2 128 711 C3 | 3/1972 |
| DE | 1 95 36 061 A1 | 4/1997 |
| EP | 1 045 147 A2 | 10/2000 |
| WO | WO 97/12124 | 4/1997 |

* cited by examiner

*Primary Examiner*—Thomas E. Lazo
(74) *Attorney, Agent, or Firm*—McCormick, Paulding & Huber LLP

(57) ABSTRACT

The invention concerns a method and a hydromachine with a commutation device and with expanding and contracting pressure chambers passed by fluid and formed by displacement arrangements. With the method and the hydromachine, it is endeavoured to control a displacement in the hydromachine to keep pressure fluctuations small. For this purpose, the hydromachine has a group of devices, comprising a commutation device and at least two displacement devices, at least two of the devices being adjusted in relation to each other.

21 Claims, 5 Drawing Sheets

METHOD AND HYDROMACHINE FOR CONTROLLING A DISPLACEMENT

CROSS-REFERENCE TO RELATED APPLICATIONS

Applicant hereby claims foreign priority benefits under U.S.C. §119 from German Patent Application No. 10 2004 020 357.1, filed on Apr. 26, 2004 the contents of which are incorporated by reference herein.

FIELD OF THE INVENTION

The invention concerns a method for controlling a displacement in a hydromachines.

The invention also concerns a hydromachine, in which the method according to the invention can be used.

BACKGROUND OF THE INVENTION

The term "hydromachine" comprises pumps and hydromotors, in which a hydrostatic power conversion of a fluid takes place according to the displacement principle. Such machines are therefore also called displacement machines. With the displacement principle, the space required inside the hydromachine for producing a volume flow will be reduced and expanded again during a function period.

With hydromachines, there are two different principles of action, namely rotating machines and piston machines. In rotating machines, the supply process of the fluid takes place in the circumferential direction. For example, gearwheels or vanes are used as displacement elements. Piston machines, however, have displacement elements in the form of pistons, which perform a linear movement to cause a displacement of the fluid.

The present invention relates to hydromachines of any kind and will in the following be explained on the basis of a rotating machine.

EP 1 045 147 A2 describes a hydromachine according to the displacement principle, which produces the torque on a working shaft by means of the temporal change of the geometry of pressure chambers with differently large active surfaces between a toothed ring and an eccentrically rotating gear wheel rotor. During normal operation, with slowly rotating shaft with high torque, the fluid inlet is connected with all expanding pressure chambers, and all contracting pressure chambers are connected with the fluid outlet. During high-speed operation with low torque, a recirculation of the fluid is produced by a design ensuring that a fluid amount leaving the contracting pressure chambers is led back to some expanding pressure chambers. This happens in that a valve slide can be brought into two positions on a channel plate. In a first position of the valve slide, pressure chambers are open and a recirculation of the fluid is possible, and in a second position all pressure channels are closed by the valve slide, so that no recirculation can take place.

The recirculation thus causes a deterioration of a displacement in the hydromachine with unchanged flow through the hydromachine. The transition from low-speed operation to high-speed operation can take place in one step or in intermediary steps, when the recirculated fluid rate is not led through a commutation plate but through a control plate.

U.S. Pat. No. 4,493,622 describes a hydromachine, which is controlled in dependence of a load on a working shaft. The hydromachine has the form of a displacement motor and has one or more gear wheel sets. Between a toothed ring and a motor housing, free chambers are placed on the circumference, in which mechanical springs are installed. A minimum displacement of the hydromachine exists, when the hydromachine is in a state with low torque. With increasing load on the working shaft of the hydromachine, the pressure is increased in the pressure chambers, which are facing the fluid inlet. This leads to an increase of the torque, which acts upon both a gear wheel rotor and on a toothed ring. If this torque exceeds the tension force of the springs in the free chambers between toothed ring and housing, the springs are compressed and the toothed ring performs a rotationally limited movement. This movement of the toothed ring will increase the displacement of the hydromachine, and thus also the torque on the drive shaft.

With the methods of controlling the displacement, which have been known until now, pressure fluctuations occur in the hydromachine.

SUMMARY OF THE INVENTION

The invention is based on the task of providing a method and a hydromachine, with which the displacement in the hydromachine is controlled to keep pressure fluctuations small.

With the method as mentioned in the introduction, this task is solved in that the hydromachine has a group of devices, comprising a commutation device and at least two displacement devices, at least two of the devices being adjusted in relation to each other.

With the invention at least three devices, a commutation device and at least two displacement devices, which are connected with each other through pressure chambers, are aligned in relation to each other. There are different possibilities of offsetting the devices. For example, all devices can be adjusted in relation to each other. It is also possible that one or more devices are not adjusted, and that at least two of the devices are adjusted in relation to each other. With two available displacement devices, it is possible to adjust two of the displacement devices, whereas the commutation device is not adjusted. It is also possible to adjust only one displacement device and the commutation device. With more than two available displacement devices, it is possible to adjust a number of at least two displacement devices and also to adjust the commutation device or leave it in its starting position. The devices are adjusted to enable the control of the displacement inside the hydromachine. The adjustment is used to keep transient undesired pressure fluctuations in the hydromachine small.

It is particularly preferred that the course over time of the sum of the displacements of communicating pressure chambers of different displacement devices is brought in phase with the temporal pressure course of the allocated area of the commutation device. A phase equality of these two courses over time means that each time of the transition of the common pressure volume of the communicating pressure chambers of the displacement devices from a contracting working phase into an expanding working phase and also from an expanding working phase into a contracting working phase coincides with a time of the minimum flow surfaces at the area of the commutation device, which is allocated to the pressure chambers in the displacement device. Thus, forces in the hydromachine are avoided, which would otherwise occur due to a temporally large displacement of the displacement devices at simultaneous minimum flow surface at the allocated area of the commutation device. A minimum flow surface can be made so that it is closed and permits no penetration of fluid.

It is particularly advantageous that the course over time of the sum of the displacements of communicating pressure chambers of different displacement devices is generated with the same frequency as the temporal pressure course of the allocated area of the commutation device. When the pressure course and the course of the sum of the displacements have the same frequency, all transitions from the expanding working phase into the contracting working phase and vice versa coincide with all temporally minimum flow surfaces of the commutation device, which is allocated to the sum of the displacements of communicating pressure chambers of different displacement devices. With this process, the minimum flow surface of the commutation device at that time will continuously be used to realise a gentle transition when switching the working phases.

In an advantageous manner it is ensured that the courses over time of the displacements of communicating pressure chambers of different displacement devices are brought out of phase. With the preceding features, it is also possible that the sum of the displacements of communicating pressure chambers occur in that, for example, the course over time of the sum of two communicating chambers occurs, which are equal in frequency, but do not differ in their phase position. The formation of the temporal sum of the displacements causes a simultaneous adding of the maximum values, and the hydromachine must be dimensioned accordingly. As opposed to this, the present variant proposes to bring the courses over time of the displacements of communicating pressure chambers of different displacement devices out of phase, so that the temporal summing with the same displacement as in the variant above will give a lower maximum value and keep pressure fluctuations inside the hydromachine even smaller.

Preferably, maximum values of the displacements of communicating pressure chambers of different displacement devices are generated to be equal in amount. In this way, the course over time of the sum of the displacements of communicating pressure chambers of different displacement devices assumes a regular shape. This has a positive influence on a regular temporal pressure course inside the hydromachine.

It is also particularly preferred that maximum values of the displacement of one pressure chamber are generated to be equal in amount in both the expanding and the contracting working phase. This means that the pressure chamber is equally loaded. This, for example, happens when the maximum volume of the pressure chamber in the contracting working phase is equal to the maximum volume of the identical pressure chamber in the expanding phase.

In a rotational machine, it is preferred that at least one element of at least two devices are adjusted rotationally in the circumferential direction with different rotation angles in relation to each other. Adjustable elements can, for example, be toothed rings of the displacement devices and channel or control plate of a commutation device. Thus, for controlling the displacement, at least three elements of different devices are aligned in relation to each other, at least two of the elements being adjusted with different rotation angles. A rotation angle is described by means of its rotation direction and its angle amount. Thus, it is, for example, possible that the rotation angles of at least two elements are equal in amount, the elements, however rotating in different directions. It is also possible that at least two elements rotate in the same direction. With the same rotation direction of all adjusted elements, at least one element has a different amount of the rotation angle, so that also here at least two elements are adjusted by different rotation angles.

Preferably, in a rotational machine, the commutation device is adjusted in relation to its commutation axis and the displacement devices are adjusted in relation to their individual eccentricity axes, each by a rotation angle, the commutation axis and the eccentricity axes having corresponding starting positions. The eccentricity axis of a displacement device is perpendicular to the flow direction of the fluid and separates the area of the expanding pressure chambers from the area of contracting pressure chambers. The commutation axis of the commutation device separates the area generating the high pressure of the commutation device from the area of the commutation device, which simultaneously generates no pressure or almost no pressure, as it is, for example, connected with the fluid outlet.

Preferably, the eccentricity axes are adjusted reversely proportional to the relation of the displacements of the displacement devices with opposite offsetting directions. This embodiment is particularly advantageous, when gear wheel sets have different displacements. This can, for example, occur with different diameters of the gear wheel sets or differently designed pressure chambers. If, for example, two gear wheel sets are available, and the second gear wheel set has twice the displacement of the first gear wheel set, the first gear wheel set is, for example, adjusted by +10° and the second gear wheel set by −5°. With a fourfold displacement of the first gear wheel set in relation to the second gear wheel set, the first gear wheel set is, for example, adjusted by +2.5° in one direction, whereas the second gear wheel set is adjusted in the opposite direction by the angle −10°. The displacement can also be controlled by means of the commutation device in connection with the adjusted displacement devices.

Preferably, the commutation axis is adjusted from its starting position by half the sum of all rotation angles of the adjusted eccentricity axes. With this embodiment variant, the displacement inside the hydromachine is particularly efficiently controlled to prevent pressure fluctuations. With a rotational machine, the embodiment variant for example provides that a toothed ring is turned by a rotation angle from its starting position in relation to its eccentricity axis of a displacement device and a further toothed ring is also turned by a rotation angle from its starting position in the opposite or the same direction in relation to its eccentricity axis of a second displacement device. If the amounts of the rotation angles of the two toothed rings are equal and the toothed rings are turned in opposite directions, the rotation angle of the commutation device in relation to its commutation axis is zero, and consequently it maintains its starting position. When, however, the two toothed rings are turned in the same direction, an offsetting of the commutation device is necessary to observe the proposed embodiment variant. With more than two adjusted toothed rings, the condition of adjustment can also be observed. Here, it is also possible that one or more toothed rings are not adjusted, and are not even made to be adjustable. With a corresponding adjustment of more than two toothed rings, further cases occur, in which the rotation angle of the commutation device is zero, the commutation device either not being adjusted or not being made to be adjustable at all.

Preferably, the devices are adjusted by means of an adjustment device. An adjustment device can act from the outside upon the devices to be adjusted. Thus, it is possible that the devices to be adjusted are controlled mechanically, hydraulically, electrically or in similar manners to perform the adjustment movement.

The task of the invention is also solved by means of a hydromachine as mentioned in the introduction in that it has a group of devices, comprising a commutation device and at least two displacement devices, at least two of the devices being adjustable in relation to each other by means of an adjustment device. The hydromachine can be designed so that, for example, two displacement devices are adjustable in relation to each other, the commutation device not being adjustable. Also, only one displacement device and the commutation device can be adjustable. Thus, at least three devices are adjusted in relation to each other, at least two of the devices being adjustable. When more than two displacement devices are available in the hydromachine, all combinations of adjustment can be imagined, on condition that at least two of the devices, commutation device and displacement devices, are made to be adjustable. When, for example, more than two devices are made to be adjustable, it is not required to adjust all the devices being adjustable.

In an embodiment variant, the adjustment device has mechanical, hydraulic, electrical or magnetic means. This means can be used in a space-saving manner, and are partly already available in hydromachines. A hydromachine can have several adjustment devices.

In a simple, practical embodiment, the adjustment device has mechanical actuating elements. Mechanical actuating elements can, for example, be cams or geometries engaging each other. This are particularly advantageous in use, when, for example, in a rotational machine the circumference of a toothed ring of a displacement device has corresponding geometries, which are connected with the mechanical adjustment device. The adjustment can then be located between one or more adjustable elements and the housing of the hydromachine.

Preferably, at least two free spaces between an adjustable element of the device and a fixed component of the device can be acted upon by the hydraulic means. In rotational machines, hydraulic means can, for example, be active in free spaces between an inner toothed ring and an outer toothed ring of a displacement device, to initiate an adjustment movement. Also in the commutation device hydraulic means are easy to use as adjustment possibility, as here free spaces are provided, which are connected with the hydraulically acting adjustment device.

It is particularly preferred that the devices are infinitely adjustable. An infinite adjustment permits a continuous speed change of the hydromachine shaft. Thus, an infinite adjustment device extends the speed range of the hydromachine. Also from mechanical points of view an infinite adjustment device is advantageous, as a speed change will cause less stress to the components of a machine than a stepwise change of the adjustment position.

In a hydromachine in the form of a rotational machine it is particularly preferred that it has a commutation device and at least two gear wheel sets, each with a gear wheel and a toothed ring, the commutation device and at least two toothed rings forming a group of elements, at least two of said elements being rotationally adjustable in relation to each other in the circumferential direction by means of the adjustment device. In this embodiment variant, the toothed rings, which are usually fixed, can be moved in a rotationally limited manner. This means that they are adjustable by a segment, which is smaller than 360°.

Preferably, the relation of the displacements to the gear wheel sets is reversely proportional to rotation angles in the opposite direction of the adjusted toothed rings. When, for example, the hydromachine has two gear wheel sets, the first gear wheel set having twice the displacement of the second gear wheel set, for example, the toothed ring of the first gear wheel set is adjustable by −5° in one direction and the toothed ring of the second gear wheel set is adjustable by +10° in the opposite direction. The displacement can also be controlled by the commutation device in connection with the adjusted displacement devices.

Preferably, the commutation device can be turned by half the sum of all rotation angles of the adjusted toothed rings. The adjustment of the commutation device depends on the rotation angles of the toothed ring or of several toothed rings. It can, for example, be imagined that two toothed rings are adjusted in opposite directions by angles having the same value. As the sum of the two angles will be zero because of their different algebraic signs, it is not necessary for the commutation device to be rotational at all in this case.

In another case, when for example two toothed rings are adjusted in the same direction by the same rotation angle, the channel plate should be adjustable in the same direction by half the sum of the two angles, in this case exactly by the rotation angle of the commutation device. In this case, the two gear wheel sets with identical rotation of their toothed rings act like a gear wheel set with a larger geometrically axial extension.

With, for example, four available gear wheel sets, it is also possible that two of the toothed rings are adjustable in one rotation direction, the two other toothed rings being adjustable in the opposite rotation direction. When, for example, the rotation angle for the first toothed ring is +5°, for the second toothed ring −5°, for the third toothed ring +10° and for the fourth toothed ring −10°, the rotation angle of the channel plate is 0°. This means that the channel plate does not have to be made to be adjustable. For the flow behaviour inside the hydromachine it is advantageous, when, as in this example, the toothed rings are adjustable alternatingly in positive and negative directions. However, this is not absolutely necessary. With more than two gear wheel sets in the hydromachine, it can also be imagined that one or more gear wheel sets in random positions inside the hydromachine are not adjustable.

In a particularly simple practical embodiment of the invention, free spaces in at least one toothed ring are provided with an outer toothed ring and an inner toothed ring. With at least two controllable free spaces an adjustment in the opposite rotation direction at a toothed ring is possible. When controlling a free space, the adjustable toothed ring is exposed to a pressure, which causes a turning of the possibly movable inner toothed ring in one rotation direction. When controlling a possibly oppositely located free space, the hydraulic means cause an adjustment in the opposite rotation direction.

In an advantageous manner it is ensured that all devices can be adjusted by one single adjustment device. This provides a simple manner of synchronising the adjustment movements. Also design advantages occur through the use of only one single adjustment device, for example the possibility of a more efficient utilisation of limited space.

BRIEF DESCRIPTION OF THE DRAWINGS

In the following, the invention is described in detail on the basis of preferred embodiments in connection with the drawings, showing.

DETAILED DESCRIPTION OF THE PREFERRED EMBODIMENTS

Figure 1:
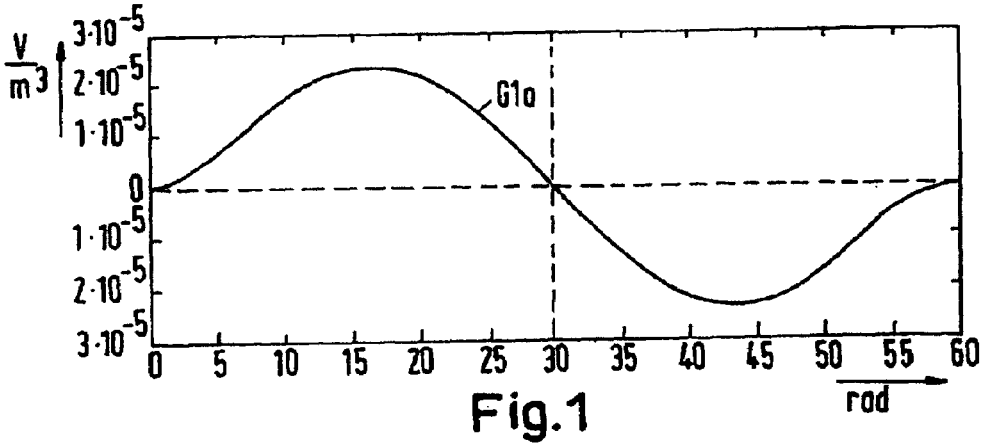
FIG. 1 is a graph showing a course over time of the displacement of a pressure chamber of a displacement device (state of the art)
Figure 2:
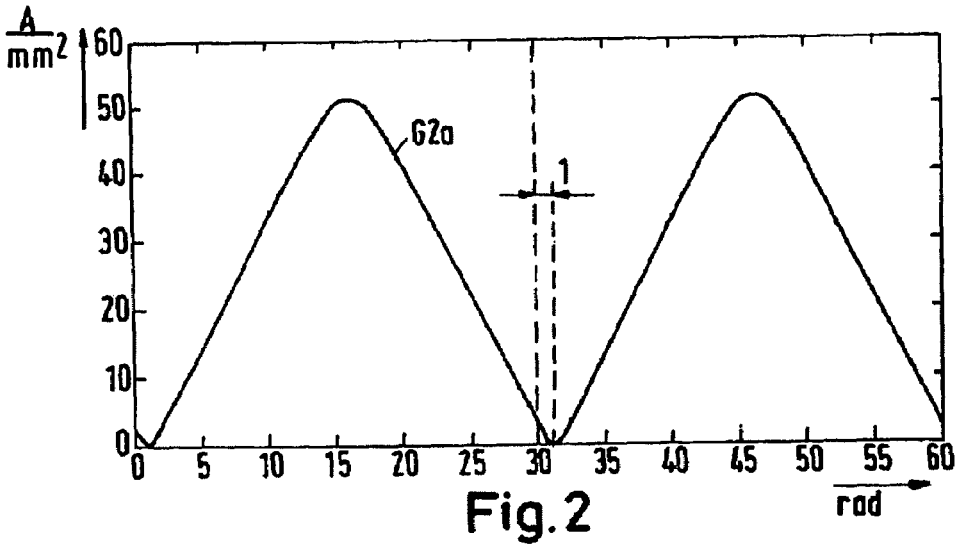
FIG. 2 is a graph showing a course over time of the flow face of the commutation device area, which is allocated to the pressure chamber of FIG. 1 (state of the art)
Figure 3:
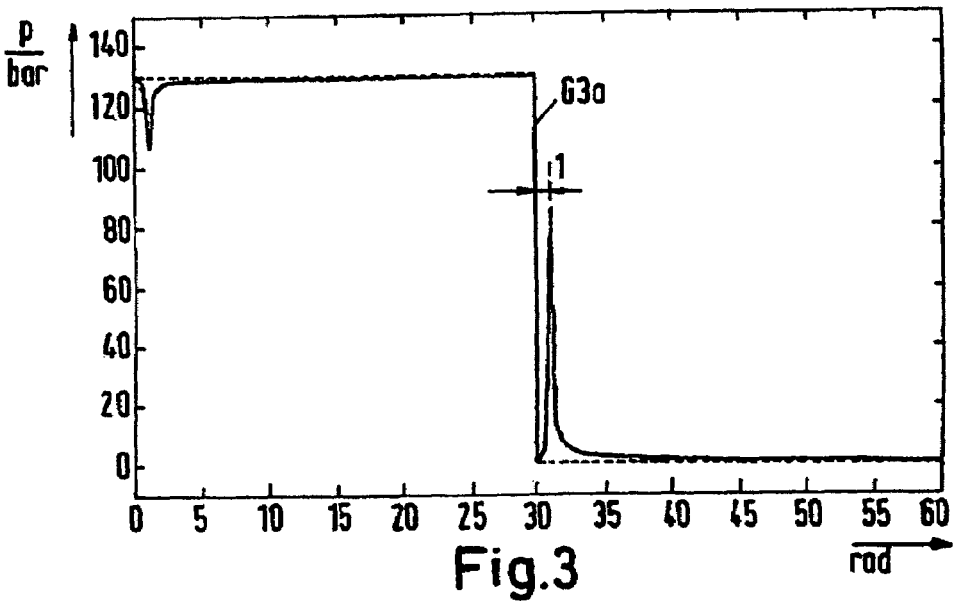
FIG. 3 is a graph showing a course over time of the pressure at the commutation device area, which is allocated to the pressure chamber according to FIG. 1 (state of the art)

In the following, the principle of the invention is explained by way of a hydromachine 1 in the form of a rotational machine and displacement devices in the form of gear wheel sets 2, 3. The FIGS. 1 to 3 show courses over time relating to processes inside a rotational machine, which processes are known from the state of the art. The rotational machine shown here comprises one single toothed wheel having six teeth and rotating with the shaft of the machine, so that the displacement process of each pressure chamber of the toothed wheel is repeated after a rotation angle of the shaft of 60° (360°:6=60°).

FIG. 1 shows a course over time of the displacement V of a pressure chamber of the displacement device G1*a*. Two areas occur in the course over time. In the first area from 0° to 30° the pressure chamber contracts and the fluid flows into this pressure chamber. In the second area from 30° to 60° of the rotation angle the pressure chamber is expanding and the fluid flows out of this pressure chamber again. This means that the pressure chamber has its maximum volume at a rotation angle of about 30°.

FIG. 2 shows a course over time of the flow face A of the commutation device G2*a*, which is allocated to the pressure chamber of FIG. 1. Usually, there is a phase difference between the courses over time of the curves G1*a* (FIG. 1) and G2*a* (FIG. 2). In the example shown, the phase difference amounts to approximately 1°. Due to this phase difference, pressure fluctuations occur inside the hydromachine, which superimpose the temporal pressure course.

FIG. 3 shows the resulting pressure course G3*a*, to which the pressure chamber of the displacement device is exposed, and which is predetermined by the commutation device. In this example, the pressure p at the fluid inlet amounts to 130 bar and at the fluid outlet to 0 bar. The pressure course G3*a* is a combination of the temporal pressure change course of the commutation device and the undesired pressure fluctuations, which occur from the phase difference of the two courses over time G1*a* and G2*a* of the FIGS. 1 and 2.

Figure 4:
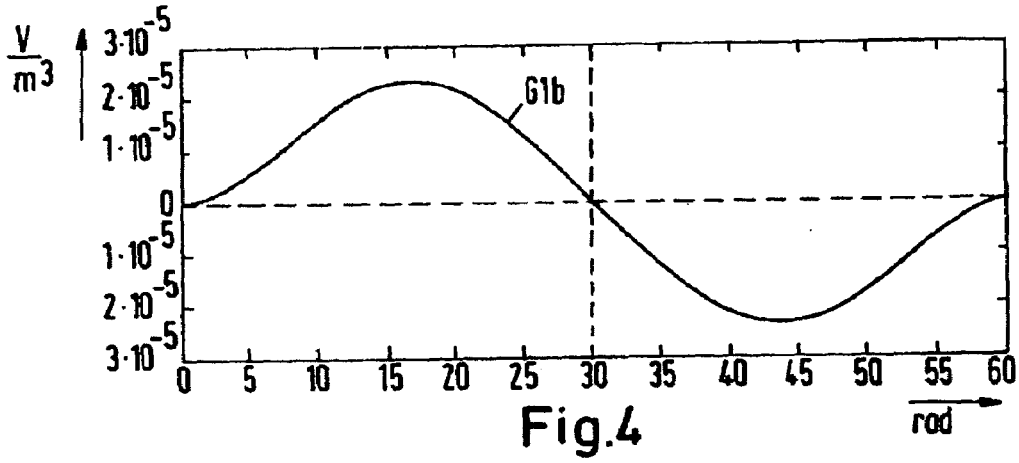
FIG. 4 is a graph showing a course over time of the sum of displacements of communicating pressure chambers of different displacement devices.
Figure 5:
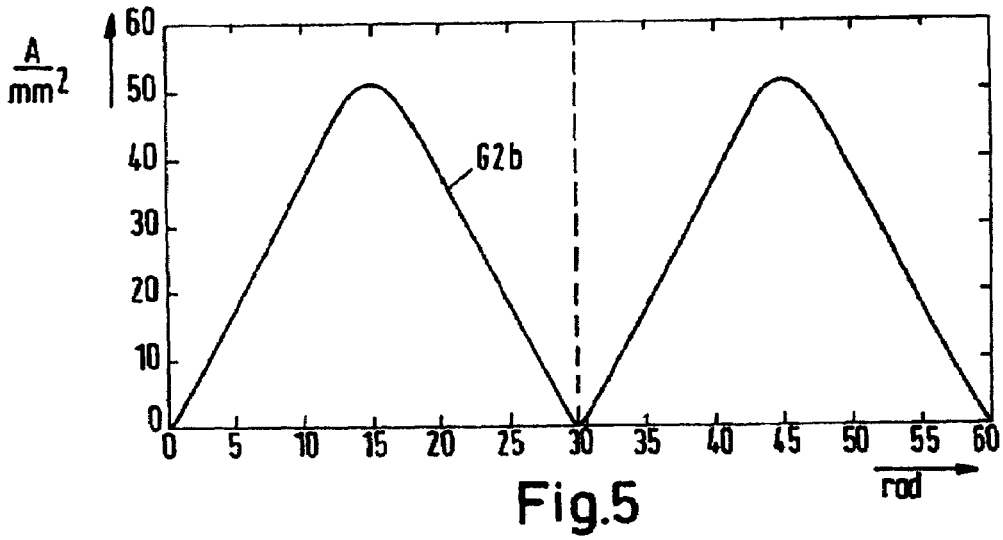
FIG. 5 is a graph showing a course over time of the flow face of the commutation device area, which is allocated to the pressure chambers of FIG. 4.
Figure 6:
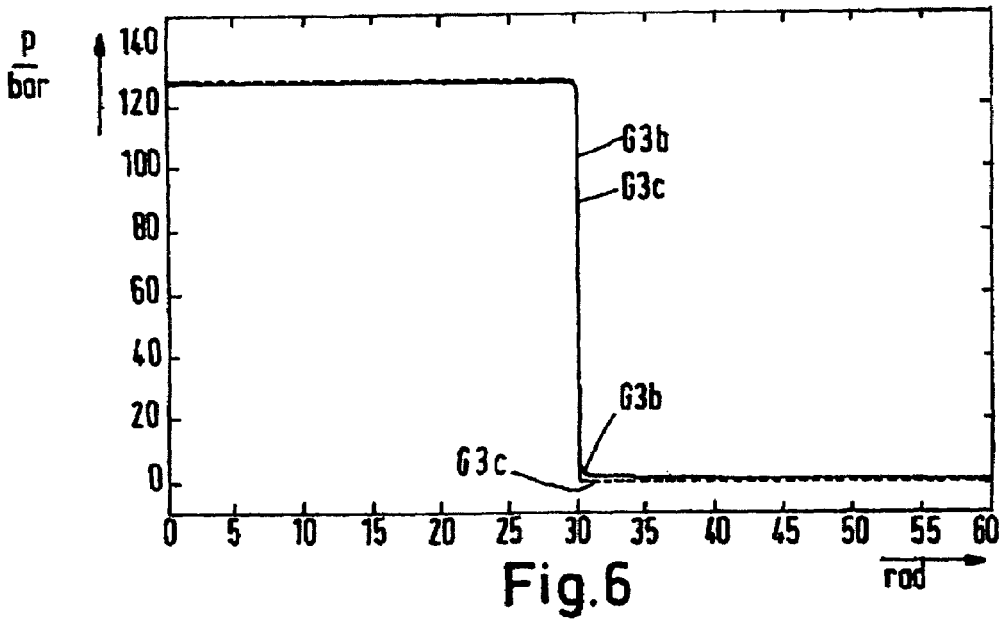
FIG. 6 is a graph showing a course over time of the pressure at the commutation device area, which is allocated to the pressure chambers of FIG. 4.

Compared with the state of the art (FIGS. 1 to 3), the FIGS. 4 to 6 show the method according to the invention. In the case of only one gear wheel set in the hydromachine, FIG. 4 shows the course over time of the displacement V as previously described in FIG. 1. According to the invention, the hydromachine has at least two displacement devices. In this case, FIG. 4 shows a course over time of the sum of the displacements G1*b* of the communicating pressure chambers of different displacement devices. This sum is a calculated value and will be explained below by means of FIG. 7.

Like FIG. 2, FIG. 5 also shows the course over time of the flow face of the commutation device G2*b*. In this case, however, the flow face of the commutation device allocated to the displacement devices is allocated to the course over time of the sum of the displacements. Contrary to the state of the art, the course over time G1*b* in FIG. 4 and the course over time G2*b* in FIG. 5 have been brought into phase. In this case, the change from a contracting working phase to an expanding working phase, caused by the sum of all communicating pressure chambers of the displacement devices, coincides with the time, at which the allocated flow face of the commutation device is at a minimum.

FIG. 6 shows the resulting pressure course G3*b*, to which communicating pressure chambers of the displacement devices are exposed. Compared with FIG. 3, curve G3*a*, and with the same parameters, undesired pressure fluctuations inside the hydromachine will be avoided according to curve G3*b*. The measured curve of the pressure course G3*b* practically assumes the ideal shape of the theoretical curve G3*c* as skip function. The pressure course G3*b* has a positive effect on the efficiency and the life of the machine. Reduced pressure fluctuations in the machine improve the speed stability and the torque stability in the stationary operation. The method also provides an improvement of the starting torque compared with the state of the art method. The reason for this is the correction of the non-synchronised commutation.

Figure 7:
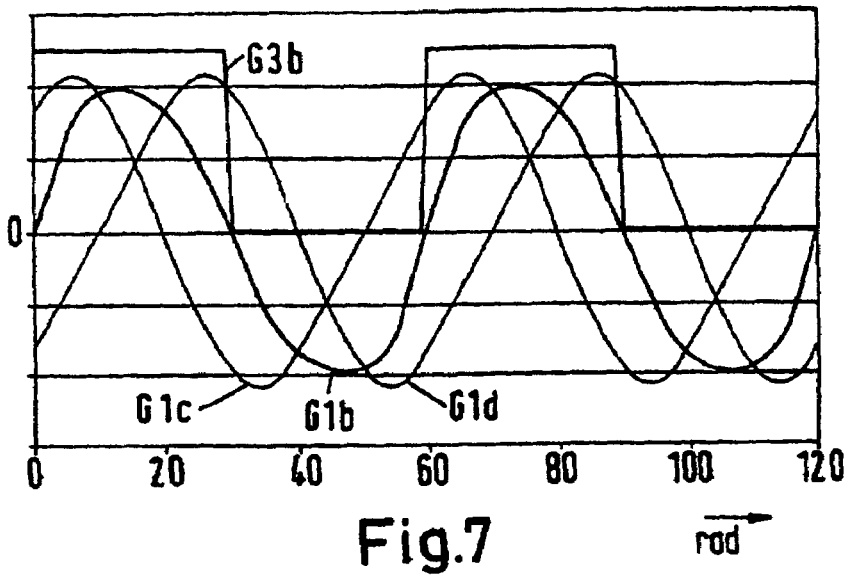
FIG. 7 is a graph showing a course over time of the sum of displacements according to FIG. 4 and courses over time of the displacements of individual pressure chambers.

By means of FIG. 7 it is explained, how the sum of the displacements of communicating pressure chambers of the different displacement devices occurs. Curve G1*b* is already known from FIG. 4 and curve G3*b* from FIG. 6. The curve G1*c* shows the course over time of the displacement of a pressure chamber of a first displacement device. Accordingly, the curve G1*d* shows the course over time of the displacement of a second pressure chamber of a second displacement device communicating with the first pressure chamber. The curve G1*b* occurs from the addition of the curves G1*c* and G1*d*. The courses over time G1*c* and G1*d* are chosen so that the curve G1*b* is in phase with and frequency-equal to the temporal pressure course G3*b*. This means that the courses over time of the displacements of the communicating pressure chambers of the individual displacement devices can be phase-offset in relation to each other. In the present example, the curve G1*d* is leading by 10° and the curve G1*c* is following by 10° in relation to the curve G3*b* of the commutation device. The phase offsets of the individual displacement devices are set by means of an adjustment device at the first and the second displacement device. When, in another application case, the commutation device is adjusted, the curve G3*b* is offset. This can also be set so that again the curves G1*b* and G3*b* are in phase with each other. With more than two displacement devices, the curve G1*b* accordingly occurs from the addition of the courses over time of the displacements of the communicating pressure chambers of the displacement devices.

Figure 8:
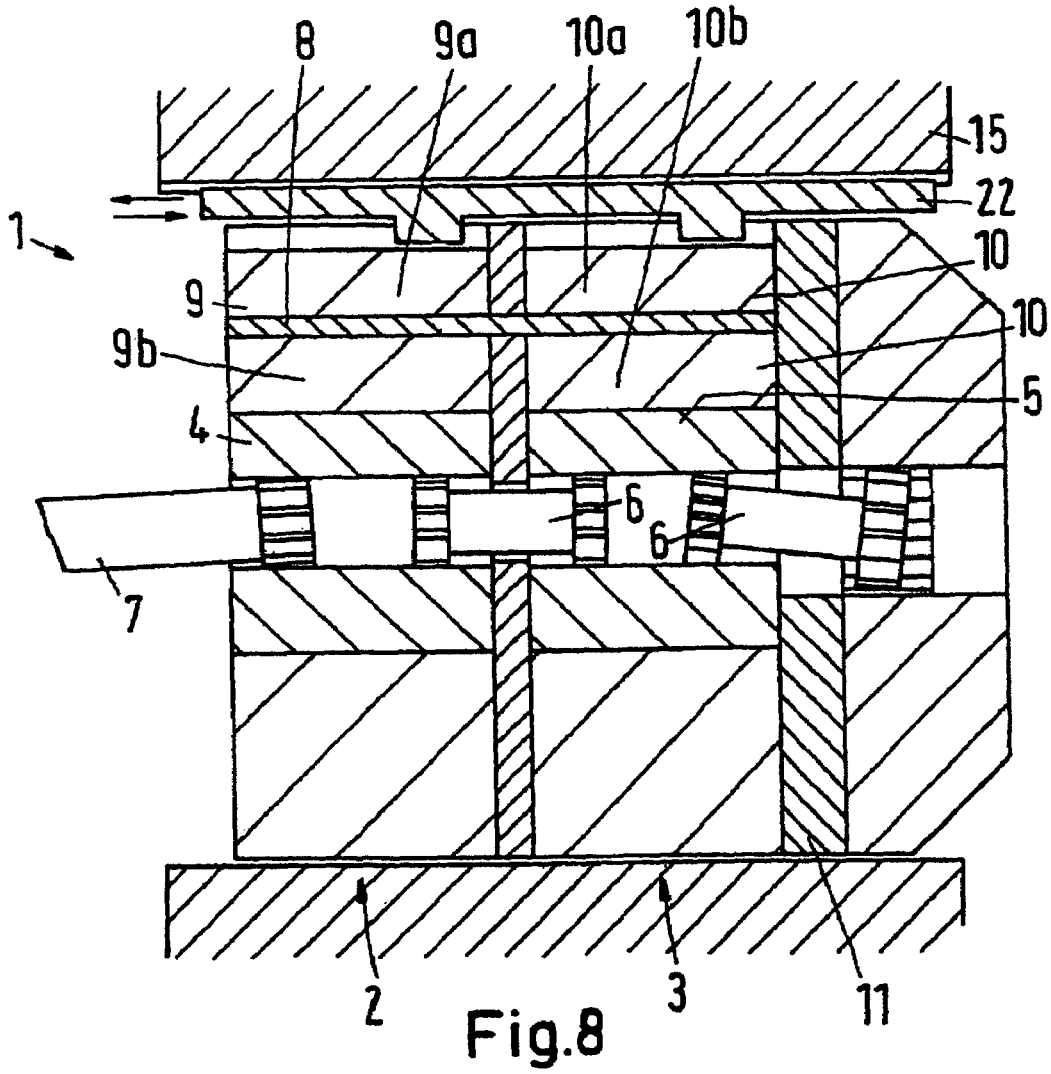
FIG. 8 is a cross sectional view of a hydromachine with two displacement devices and one commutation device.

FIG. 8 shows a hydromachine 1 as a rotational machine with two displacement devices in the form of gear wheel sets 2, 3.

The gear wheel sets 2, 3 have gear wheel rotors 4, 5, which are connected with each other via a cardan shaft 6, thus rotating in the same rotation direction. The two gear wheel rotors 4, 5 drive a shaft 7, which is connected with one of the gear wheel rotors 4. Pressure chambers occur between the gear wheel rotors 4, 5 and toothed rings 9, 10, the geometry of said chambers changing temporally through the eccentrically rotating gear wheel rotors 4, 5, the expanding pressure chambers being connected with a fluid inlet and the compressing pressure chambers being connected with a fluid outlet via a commutation device in the form of a channel plate 11.

Figure 9:
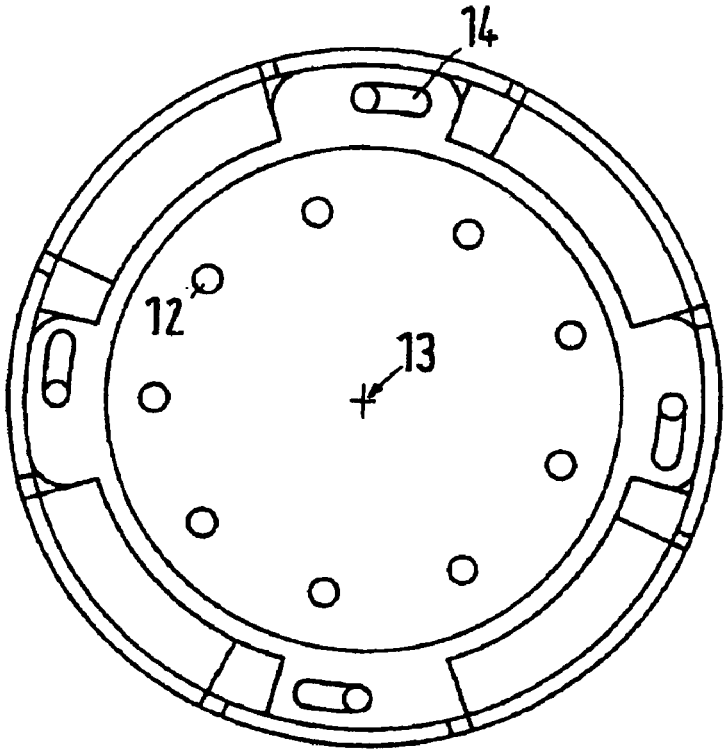
FIG. 9 shows an adjustable channel plate as commutation device.

The number of the channels 12 in the channel plate 11 in FIG. 9 corresponds to the number of pressure chambers of a gear wheel set, the number of pressure chambers of all gear wheel sets being identical. The fluid can flow freely between the gear wheel sets. The channel plate 11 can be adjusted in a rotationally limited manner with regard to its geometrical centre 13. Oblong holes 14 are provided for this purpose. However, other possibilities exist, for example tension springs or hydraulic means.

Figure 10:
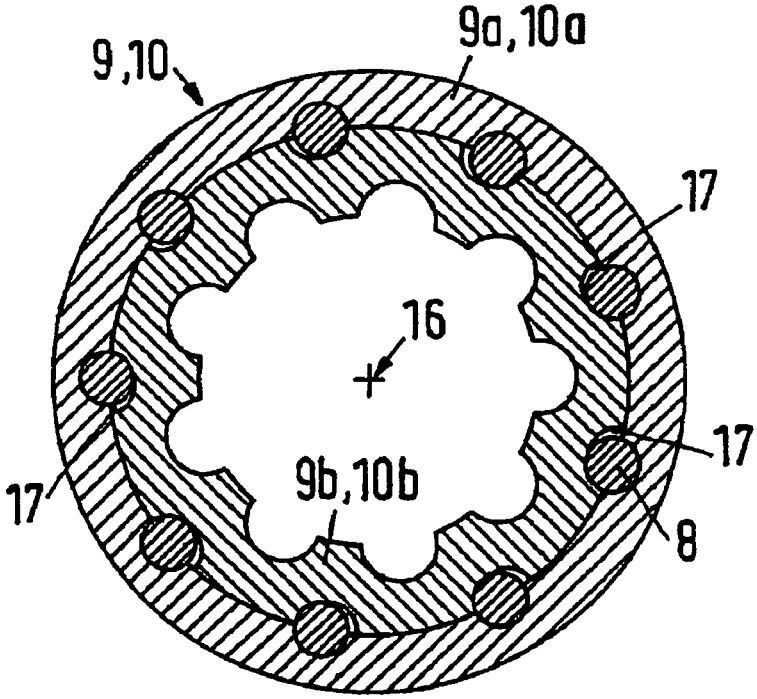
FIG. 10 is a cross sectional view of an adjustable toothed ring.

FIG. 10 shows a toothed ring 9, 10. The toothed ring 9, 10 is retained by fixed pins 8 and consists of an outer toothed ring 9*a* or 10*a*, respectively, and an inner toothed ring 9*b* or 10*b*, respectively. In relation to a housing 15, the toothed ring 9, 10 is adjustable in a rotationally limited manner with regard to its geometrical centre 16. This is enabled by free spaces 17 between the outer toothed ring 9*a* or 10*a*, respectively and the inner toothed ring 9*b* or 10*b*, respectively. When adjusting the toothed ring 9, 10, it is important that the inner toothed ring 9*b* or 10*b*, respectively, is moving to enable a change of the fluid-passed pressure chambers between the inner toothed ring 9*b* or 10*b*, respectively and the gear wheel rotor 4 or 5, respectively, to permit the control of the displacement in the hydromachine.

At least two of the elements channel plate 11 and toothed rings 9, 10 can be rotationally adjusted by an adjustment device. A first possibility is that the two toothed rings 9, 10 are adjusted and the channel plate 11 is not adjusted. It is also possible to adjust only one toothed ring, for example 9, and the channel plate 11. Further, both toothed rings 9, 10 and additionally the channel plate 11 can be adjusted.

With a hydraulic adjustment device, the adjustable devices can be acted upon by a pressure means in such a manner that they perform an adjustment movement. For this purpose, for example one or more free spaces 17 are controlled for one rotation direction and one or more oppositely located free spaces 17 are acted upon by pressure for an opposite rotation direction. This control can be used for several devices at the same time, adjustment movements in both the same direction and in the opposite direction being possible. With a hydraulic adjustment device, two adjustment positions of the adjustment devices can be realised. Thus, this adjustment device is suited for a hydromachine with two speeds. With a very fine-stepped control of the hydraulic means, for example by means of a servo-controller, it is also possible to control the displacement continuously, so that the hydromachine can be applied in a continuous speed range under avoidance of transient pressure fluctuations.

Figure 11:
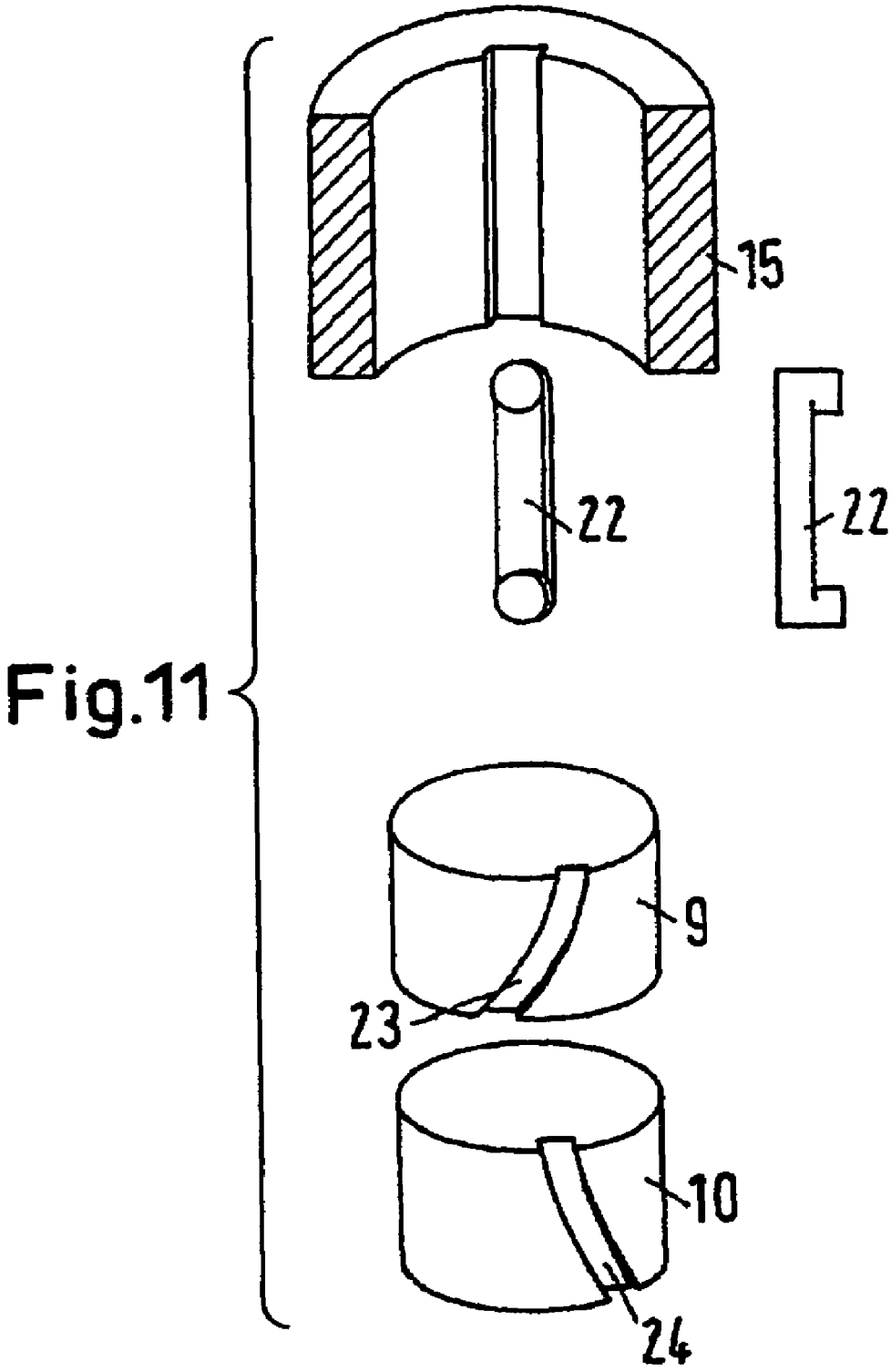
FIG. 11 is a perspective, exploded view of an example of a mechanical adjustment device.

With a mechanical adjustment device, for example with cams or components engaging each other, the operation with two speeds can be extended to the operation around the intermediate range, when the mechanical adjustment device provides an infinite, continuous adjustment possibility. Such an example is shown schematically in FIG. 11. Here, the two toothed rings 9, 10 are only shown schematically. The inner design with the distinction between the outer toothed rings 9*a* and 10*a* and the inner toothed rings 9*b* and 10*b* is not shown. Also the gear wheel rotors 4, 5 are missing in this view. By means of a guiding pin 22, which is guided in the housing 15 of the hydromachine, two toothed rings 9, 10 are turned at the same time in opposite directions. For this purpose, the pin 22 engages in a geometry in the form of an oblong recess 23 or 24, respectively, which is inclined in the circumferential direction across the length of the outer toothed ring 9*a* or 10*a*, respectively. The turning takes place continuously and permits incremental intermediary steps, so that with this adjustment possibility a continuous speed change is possible and the hydromachine can be operated with more than two speeds.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for controlling a displacement in a hydromachine with a commutation device and with expanding and contracting pressure chambers passed by fluid and formed by displacement arrangements, the method comprising:

adjusting at least two devices in relation to each other, wherein the hydromachine has a group of devices, the group of devices comprising a commutation device and at least two displacement devices;

wherein the devices are adjusted by means of an adjustment device.

2. The method according to claim 1, wherein the course over time of the sum of the displacements of communicating pressure chambers of different displacement devices is brought in phase with the temporal pressure course of the allocated area of the commutation device.

3. The method according to claim 2, wherein the course over time of the sum of the displacements of communicating pressure chambers of different displacement devices is generated with the same frequency as the temporal pressure course of the allocated area of the commutation device.

4. The method according to claim 2, wherein the courses over time of the displacements of communicating pressure chambers of different displacement devices are brought out of phase.

5. The method according to claim 2, wherein maximum values of the displacements of communicating pressure chambers of different displacement devices are generated to be equal in amount.

6. The method according to claim 2, wherein maximum values of the displacement of one pressure chamber are generated to be equal in amount in both the expanding and the contracting working phase.

7. The method according to claim 1, wherein in a rotational machine at least one element each of at least two devices are adjusted rotationally in the circumferential direction with different rotation angles in relation to each other.

8. The method according to claim 7, wherein the commutation device is adjusted in relation to its commutation axis and the displacement devices are adjusted in relation to their individual eccentricity axes, each by a rotation angle, the commutation axis and the eccentricity axes having corresponding starting positions.

9. The method according to claim 8, the eccentricity axes are adjusted reversely proportional to the relation of the displacements of the displacement devices with opposite adjustment directions.

10. The method according to claim 8, wherein the commutation axis is adjusted from its starting position by half the sum of all rotation angles of the adjusted eccentricity axes.

11. A hydromachine with a commutation device and with expanding and contracting pressure chambers passed by fluid and formed by displacement arrangements, particularly for performing the method according to claim 1, the hydromachine comprising a group of devices, comprising a commutation device and at least two displacement devices, at least two of the devices being adjustable in relation to each other by means of an adjustment device.

12. A hydromachine with a commutation device and with expanding and contracting pressure chambers passed by fluid and formed by displacement arrangements, the hydromachine comprising a group of devices, comprising a commutation device and at least two displacement devices, at least two of the devices being adjustable in relation to each other by means of an adjustment device.

13. The hydromachine according to claim 12, wherein the adjustment device has mechanical, hydraulic, electrical or magnetic means.

14. The hydromachine according to claim 13, wherein at least two free spaces between an adjustable element of the device and a fixed component of the device can be acted upon by hydraulic means.

15. The hydromachine according to claim 12, wherein the adjustment device has mechanical actuating elements.

16. The hydromachine according to claim 12, wherein the devices are infinitely adjustable.

17. The hydromachine according to 12, wherein the hydromachine is a rotational machine and has a commutation device and at least two gear wheel sets, each with a gear wheel and a toothed ring, the commutation device and at least two toothed rings forming a group of elements, at least two of said elements being rotationally adjustable in relation to each other in the circumferential direction by means of the adjustment device.

18. The hydromachine according to claim 17, wherein the relation of the displacements to the gear wheel sets is reversely proportional to rotation angles in the opposite direction of the adjusted tooted rings.

19. The hydromachine according to claim 17, wherein the commutation device can be turned by half the sum of all rotation angles of the adjusted toothed rings.

20. The hydromachine according to claim 17, wherein free spaces are provided in at least one toothed ring with an outer toothed ring and an inner toothed ring.

21. The hydromachine according to claim 12, wherein all devices can be adjusted by one single adjustment device.

* * * * *

UNITED STATES PATENT AND TRADEMARK OFFICE

CERTIFICATE OF CORRECTION

PATENT NO. : 7,188,472 B2
APPLICATION NO. : 11/107196
DATED : March 13, 2007
INVENTOR(S) : Martin Nordborg et al.

It is certified that error appears in the above-identified patent and that said Letters Patent is hereby corrected as shown below:

Column 12, Claim 18, line 16, please delete the word "tooted" and replace with --toothed--.

Signed and Sealed this

Twenty-ninth Day of May, 2007

JON W. DUDAS
*Director of the United States Patent and Trademark Office*